US009393535B2

(12) United States Patent
Xia et al.

(10) Patent No.: US 9,393,535 B2
(45) Date of Patent: Jul. 19, 2016

(54) MICROFLUIDIC MIXING APPARATUS AND METHOD

(75) Inventors: Huanming Xia, Singapore (SG); Zhiping Wang, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 749 days.

(21) Appl. No.: 13/518,845

(22) PCT Filed: Dec. 23, 2009

(86) PCT No.: PCT/SG2009/000493

§ 371 (c)(1),
(2), (4) Date: Jun. 22, 2012

(87) PCT Pub. No.: WO2011/078790

PCT Pub. Date: Jun. 30, 2011

(65) Prior Publication Data

US 2012/0269027 A1 Oct. 25, 2012

(51) Int. Cl.
*B01F 13/00* (2006.01)
*B01F 5/06* (2006.01)

(52) U.S. Cl.
CPC ..... *B01F 13/0059* (2013.01); *B01F 5/0645* (2013.01)

(58) Field of Classification Search
CPC ..... B01F 13/0059
USPC ..... 366/181.5, 336, 338, 341
See application file for complete search history.

(56) References Cited

U.S. PATENT DOCUMENTS

| | | | | |
|---|---|---|---|---|
| 5,826,977 | A | 10/1998 | Fowler et al. | |
| 6,082,891 | A | 7/2000 | Schubert et al. | |
| 6,457,854 | B1 * | 10/2002 | Koop et al. | 366/336 |
| 2005/0232076 | A1 | 10/2005 | Yang et al. | |
| 2007/0017633 | A1 | 1/2007 | Tonkovich et al. | |
| 2008/0259720 | A1 | 10/2008 | Lam et al. | |

FOREIGN PATENT DOCUMENTS

| | | | |
|---|---|---|---|
| EP | 0 853 490 | B1 | 7/2002 |
| EP | 1 403 209 | A1 | 3/2004 |
| EP | 1 997 553 | A2 | 12/2008 |
| JP | 2006-015272 | A | 1/2006 |
| JP | 2006-167719 | A | 6/2006 |
| WO | WO 96/03206 | A1 | 2/1996 |

OTHER PUBLICATIONS

Supplementary European Search Report for corresponding European Patent Application No. 09852660, 2 pages, (Mar. 19, 2014).

(Continued)

*Primary Examiner* — David Sorkin
(74) *Attorney, Agent, or Firm* — Blakely, Sokoloff, Taylor & Zafman LLP

(57) ABSTRACT

A microfluidic mixing device for mixing at least two fluids to form a mixed fluid comprising; a first mixing chamber (420) for receiving the fluids from at least two fluid paths (385, 410); a mixing zone (380) upstream from the mixing chamber (420) having a first and second fluid path; said first and second fluid paths overlapping at first and second discreet points so as to provide mutual fluid communication between the first and second paths at said discreet points.

13 Claims, 10 Drawing Sheets

(56) References Cited

OTHER PUBLICATIONS

PCT Notification of Transmittal of the International Search Report and the Written Opinion of the International Searching Authority, or the Declaration for PCT Counterpart Application No. PCT/SG2009/000493, 11 pages, (Feb. 22, 2010).
PCT Notification of Transmittal of International Preliminary Report on Patentability (Chapter II of the Patent Cooperation Treaty) for PCT Counterpart Application No. PCT/SG2009/000493, 5 pages, (Jul. 29, 2010).
Jens Branebjerg, et al., "Fast Mixing by Lamination", IEEE the Ninth Annual International Workshop on Micro Electro Mechanical Systems, pp. 441-446, (Feb. 11-15, 1996).
Volker Hessel, et al., "Micromixers—A Reviewon Passive and Active Mixing Principles", Chemical Engineering Science, vol. 60, pp. 2479-2501, (2005).
Nam-Trung Nguyen, et al., "Micromixers—A Review", Journal of Micromechanics and Microengineering, vol. 15, pp. R1-R16, (2005).
European Patent Office Communication enclosing Office Action for corresponding European Patent Application No. 09852660.1, 4 pages, (Apr. 1, 2015).

* cited by examiner 150
165
170
175
163
173
178
155
152A
152B
154
156
152

MICROFLUIDIC MIXING APPARATUS AND METHOD

CROSS-REFERENCE TO RELATED APPLICATIONS

This patent application is a U.S. National Phase Application under 35 U.S.C. §371 of International Application No. PCT/SG2009/000493, filed Dec. 23, 2009, entitled MICROFLUIDIC MIXING APPARATUS AND METHOD.

FIELD OF THE INVENTION

The invention relates to the mixing of different fluids within a microfluidic device. Further the invention relates to the manufacture of such device and its means of operation.

BACKGROUND OF THE INVENTION

In many microfluidic systems for biological and chemical applications, there is often a need for a fast and complete mixing of various solutions in order to achieve the desired result. However, in micro geometry, the viscosity of the fluid may become significant and dominate the flow characteristics of the fluid resulting in a low Reynold's number and so laminar flow. As a result, mixing depends on diffusion rather than macro scale turbulent flow which is a slow molecular process. Microfluidic mixers are known, with the degree of interference between the mixing fluids sufficient when the fluids are of a similar viscosity. However, due to the limitations of prior art microfluidic mixing devices being able to adequately interfere with the fluids, there are generally inadequate where the respective viscosities of the fluids are substantially different.

It would therefore be advantageous to have a mixing device and method of operation of such a device that introduces greater interference between the fluids in order to better and more quickly achieve the desired degree of mixing.

SUMMARY OF INVENTION

The following statements provide more specific aspects of the present invention.

In a first aspect the invention provides a microfluidic mixing device for mixing at least two fluids to form a mixed fluid comprising a first mixing chamber for receiving the fluids from at least two fluid paths; a mixing zone upstream from the mixing chamber having a first and second fluid path; said first and second fluid paths overlapping at first and second discreet points so as to provide mutual fluid communication between the first and second paths at said discreet points.

In a second aspect the invention provides a method of mixing at least two fluids to form a mixed fluid comprising the steps of: providing a microfluidic mixing device having a start chamber and a mixing chamber with a mixing zone intermediate said chambers; introducing said fluids to the start chamber; flowing said fluids through a first and second fluid path extending from the start chamber to the mixing chamber, said first and second fluid paths overlapping at a first and second discreet points; bringing fluid in the first fluid path into contact with fluid in the second fluid path at said first discreet point; diametrically swapping the first and second fluid paths; bringing the fluid of the first fluid path into contact with the second fluid path at the second discreet point.

Accordingly by providing interaction between the fluid paths are different positions, the cross sectional flow of both fluid paths are interfered with at multiple points around the peripheral edge of said fluid paths and so leading to a greater interference of flow and so better mixing. Such increased interaction further increases the surface area of interference of the fluid paths and so leading to a better mixing process.

In one embodiment, the internal substrates may provide for microfluidic fluid flow in two levels, said levels being in fluid communication so as to divide and swap flow paths between said layers.

The present invention may provide for a microfluidic mixer for fluids with widely different viscosities. It contains an interconnected multi-channel network through which the bulk fluid volumes may be divided into smaller ones and chaotically reorganized. Then, the multiple fluid streams may be driven into an expansion chamber which triggers viscous flow instabilities.

In one embodiment, the mixing effect may be at least partially attributed to the expansion effect as the first and second path enter the mixing chamber. The sudden pressure loss associated with an expansion may modify the flow from substantially laminar with the first and/or second fluid path to substantially turbulent in the mixing chamber as a result of the expansion.

In one embodiment the chamber may be of a width equal to or grater than the sum of widths of channels of the first and second fluid path immediately upstream of the mixing chamber.

BRIEF DESCRIPTION OF DRAWINGS

It will be convenient to further describe the present invention with respect to the accompanying drawings that illustrate possible arrangements of the invention. Other arrangements of the invention are possible and consequently, the particularity of the accompanying drawings is not to be understood as superseding the generality of the preceding description of the invention.

DETAILED DESCRIPTION

Figure 1A:
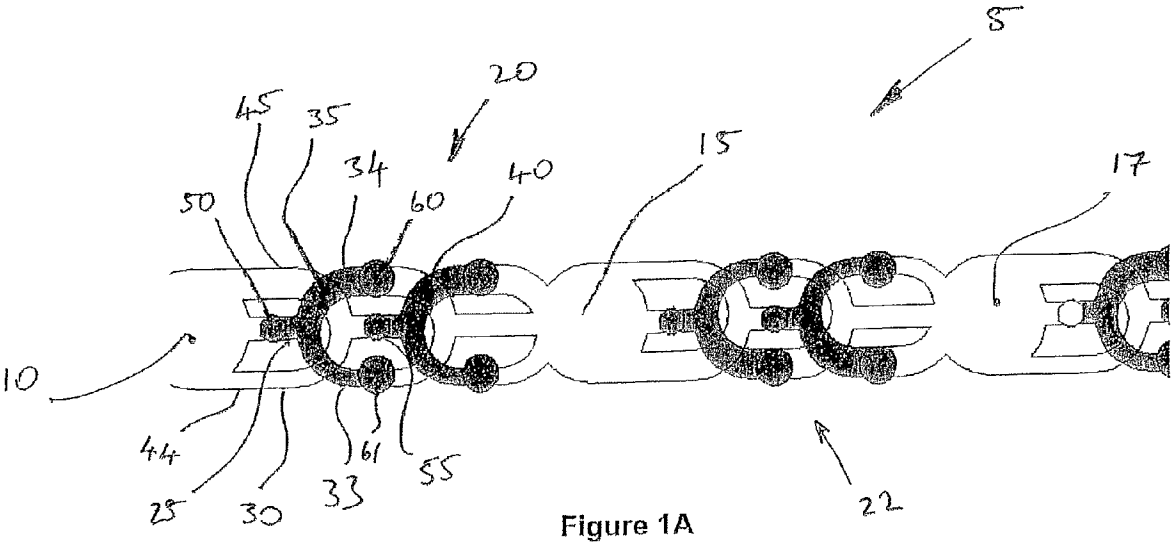
FIGS. 1A and 1B are plan views of two microfluidic mixing devices according to respective embodiments of the present invention.

FIG. 1A shows a portion of a microfluidic mixing device 5 according to one embodiment of the present invention. This portion of the microfluidic mixing device 5 demonstrates key aspects of the invention which in this embodiment are combined to provide significant interference to the fluids introduced to the microfluidic device 5. This increased interference by any one of the key features provides sufficient interaction so as to favourably mix fluids of different viscosities as will be demonstrated when describing further embodiments.

For fluids with a large viscosity differential, a stationary phase distribution should be established among the fluids before entering the chamber. Stable shear stress equilibrium exists near the fluid interface. But when the diverse fluid streams enter the mixing chamber, the equilibrium is broken down due to the sudden expansion of the geometry. The fluids must be reorganized to re-establish the equilibrium. The perturbations caused by this expansion instability will intensify the mass exchange between the different fluid species.

In the current embodiment FIG. 1A shows a microfluidic device 5 having a start chamber 10 into which two fluids ma be introduced. The start chamber 10 is separated from a mixing chamber 15 by a mixing zone 20, such that the fluids are mixed before entering the mixing chamber 15. In this portion of the microfluidic device, two cycles of mixing are provided with a second mixing cycle having the former mixing chamber 15 becoming a start chamber separated from the second mixing chamber 17 by a second mixing zone 22.

Considering the first mixing cycle, the mixing zone 20 includes two fluid paths 25, 30 which are arranged to divide the fluid within start chamber 10. The first fluid path 25 projects from the start chamber 10 centrally before entering a re-directed channel 50 so as to divert the flow out of a plane defined by the start chamber to a different parallel plane.

The second fluid path 30 is divided into two channels 44, 45 and project from the start chamber on either side of the first fluid path 25.

It will be noted that in the present embodiment, the size of one channel 45 is greater than that of the second channel 44 and so providing an asymmetrical flow characteristic between the channels 44, 45. As the magnitude of the velocity and direction of the fluid streams are different in the first fluid path and each of the channels 44, 45 of the second fluid path upon contacting, there will be strong shearing and stretching of the fluids such that the distribution pattern of the fluids will be altered through this increased interference of said flows. It will be appreciated that whilst this may have a beneficial effect, a differential channel width represents merely one embodiment, with an equal channel width also falling with the effective application of the present invention.

The first fluid path 25 is then divided into two separate channels 33, 34. Here again, the channels are of different sizes giving asymmetrical flow characteristics. The first and second fluid paths 25, 30 are positioned at different levels, and so as the fluid paths cross at a discreet point 35, the overlap provides fluid communication between the first and second fluid paths.

The divided channels 33, 34 of the first fluid path are then redirected through channels 60, 61 so as to return to the first level. The channels 44,45 of the second fluid path having engaged with the first fluid path, then recombine before being redirected through a channel 55 so as to bring the second fluid path to the second level. Consequently the fluid paths 25, 30 have now swapped relative positions between the levels.

In this swap of relative positions, the two fluid paths again overlap so as to meet at a further discreet point 40 providing further fluid communication between the fluid paths. In this instance, however, the relative positions of the fluid paths have changed and therefore interact at different points around the periphery of the cross section of the flow. Thus in this swapping of relative positions, an interaction between the fluid paths has been affected at different locations and so providing different interaction between the flows, increasing the surface area of the interference. In this instance, swapping of the relative positions of the fluid paths has been achieved at diametrically opposed positions through the arrangement of the two layers.

The channels 33, 34 of the first fluid path now recombine and progress into the mixing chamber 15 with the second fluid path being redirected back to the first level and also projecting into the mixing chamber 15. Thus in the first cycle of the microfluidic mixing device, the mixing zone 20 has provided for a number of different and substantial interferences with the flow so as to promote mixing of the two fluids. Each of these interferences arrangement is significantly greater than that of the prior art devices leading to substantial increases in the speed and completeness of mixing of the fluids.

Figure 1B:
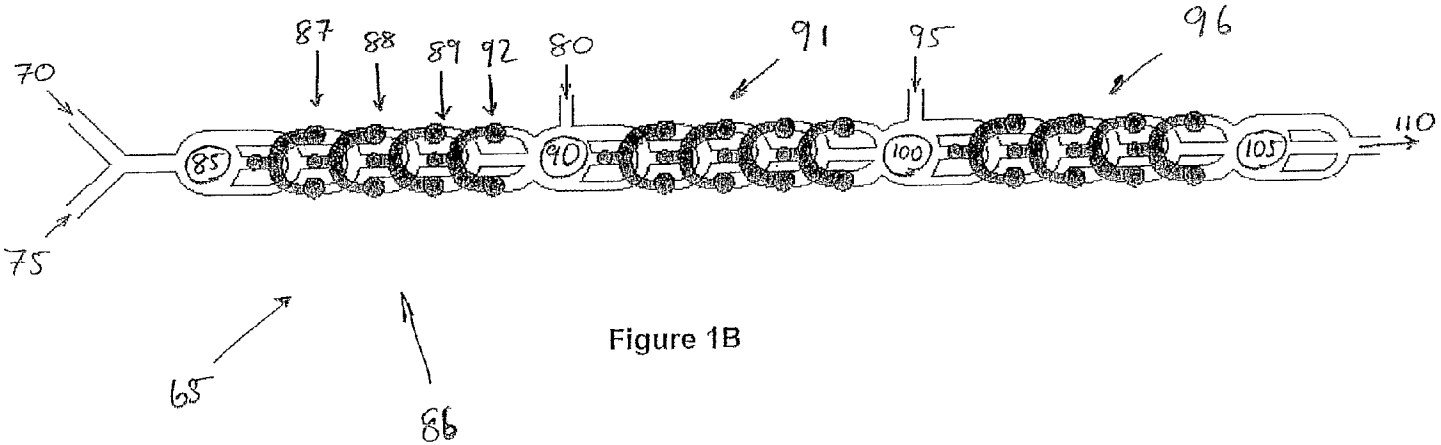

FIG. 1B shows a similar microfluidic device 65. Here two fluids 70, 75 enter the device 65 and flow into a start chamber 85. The fluids undergo mixing within a first mixing zone 86 before entering a mixing chamber 90. In this embodiment the mixing chamber 90 acts as the start chamber for the second cycle. Also in this embodiment a third fluid 80 is introduced into the chamber 90 prior to undergoing mixing within the second mixing zone 91. The mixed fluid then flows into the end/start chamber 100 which also receives a fluid inflow 95 before entering a third mixing zone 96 culminating in the mixing chamber 105 before permitting the outflow 110 of the mixed fluid. Thus the microfluidic mixing device 65 provides for mixing of four fluids through three mixing cycles.

Figures 2A, 2B, 2C, 2D, 2E, 2F, 2G:
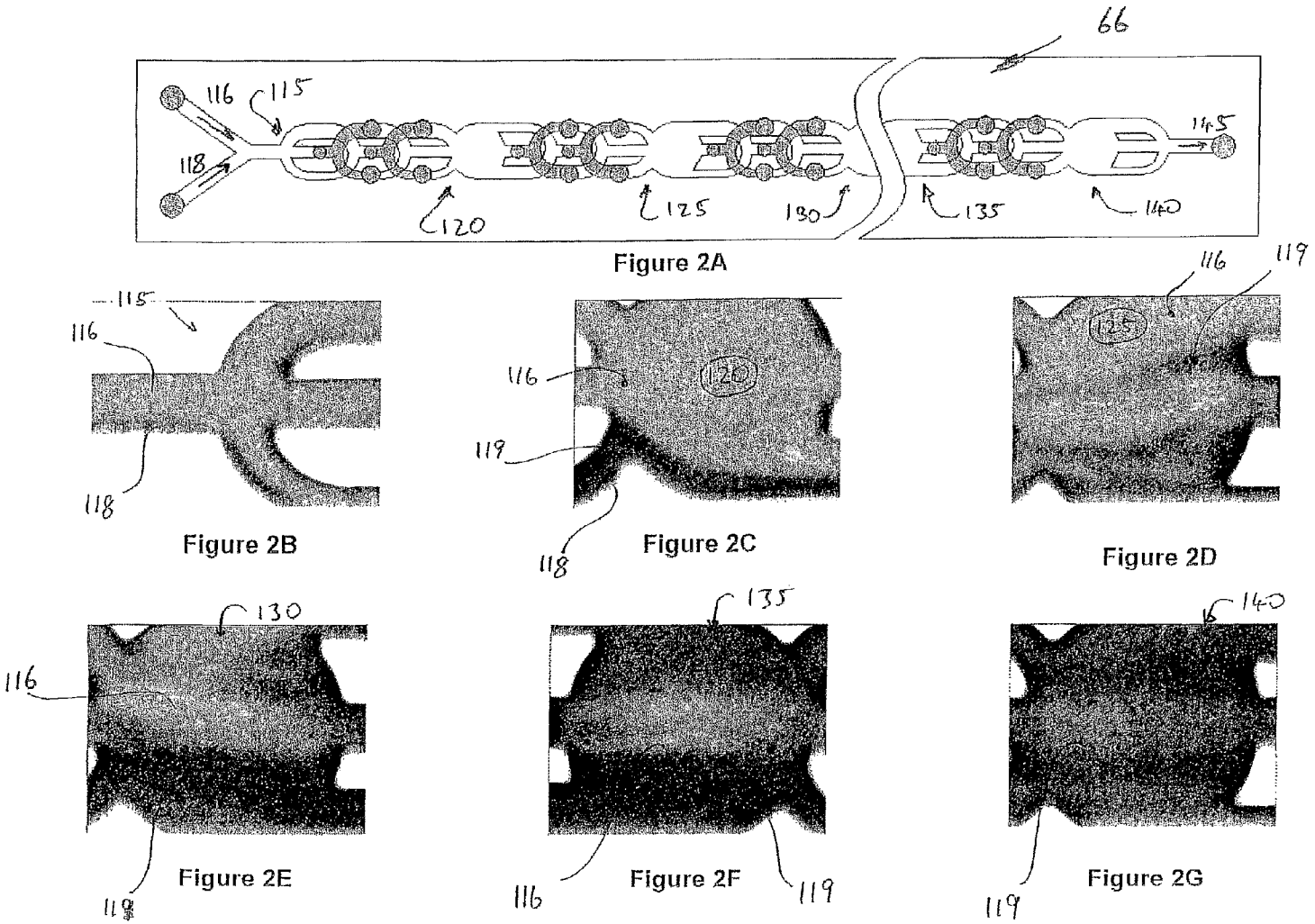
FIG. 2A is a plan view of a microfluidic mixing device according to a further embodiment of the present invention.
FIGS. 2B to 2G are sequential images of the mixing of two fluids within the microfluidic mixing device of FIG. 2A.

FIG. 2A shows a further embodiment of the present invention being a similar microfluidic device 66 having five mixing cycles (the fourth mixing cycle is not shown) separated by chambers 120, 125, 130, 135, and 140. In this case the start chamber is merely a channel 115 from which the first and second fluid paths flow. The depth of the bottom layer and top layer channel is around 500 μm. The widths of the narrow side channel, middle channel and the wide side channel are respectively 600 μm, 800 μm and 1000 μm.

FIGS. 2B to 2G show the experimental results of mixing two fluids 116, 118 being a complex polymer solution and water. The viscosity of the complex polymer (at room temperature) is around 5000 cP, while the viscosity of pure water is around 1 cP. Thus, the viscosity ratio is 5000. A small volume of food dye 2 vol % is added to the complex polymer solution as an indicator, and a flow rate of 500 μL/min used. FIG. 2B shows the distribution of the first fluid 116 (a complex polymer) and the second fluid (water) near the inlet 115. Due to the large viscosity ratio, the water is squeezed into a thin stream layer near the channel wall.

FIG. 2C shows the second chamber 120 after the first mixing cycle. It shows that the thin water threads 118 have been stretched and spread into a wider region 120. With the viscosity gap between the two fluids being reduced, the mixing process will be accelerated, leading to a greater proportion of mixed fluid 119.

FIG. 2D shows the third mixing chamber 125 which again shows the first fluid 116 dominating but with significantly increased mixed flow 119.

FIG. 2E shows the fourth chamber 130 whereby the mixed flow 119 now dominates the total flow with a significantly reduced flow of the first fluid.

FIG. 2F shows the fifth chamber 135 whereby only a very small flow of the first fluid 116 can be seen and almost totally dominated by the mixed fluid 119.

FIG. 2G shows the mixing chamber 140 whereby no portion of the first or second fluid can be seen with the chamber 140 only displaying the mixed fluid 119.

Figures 3A, 3B, 3C, 3D, 3E:
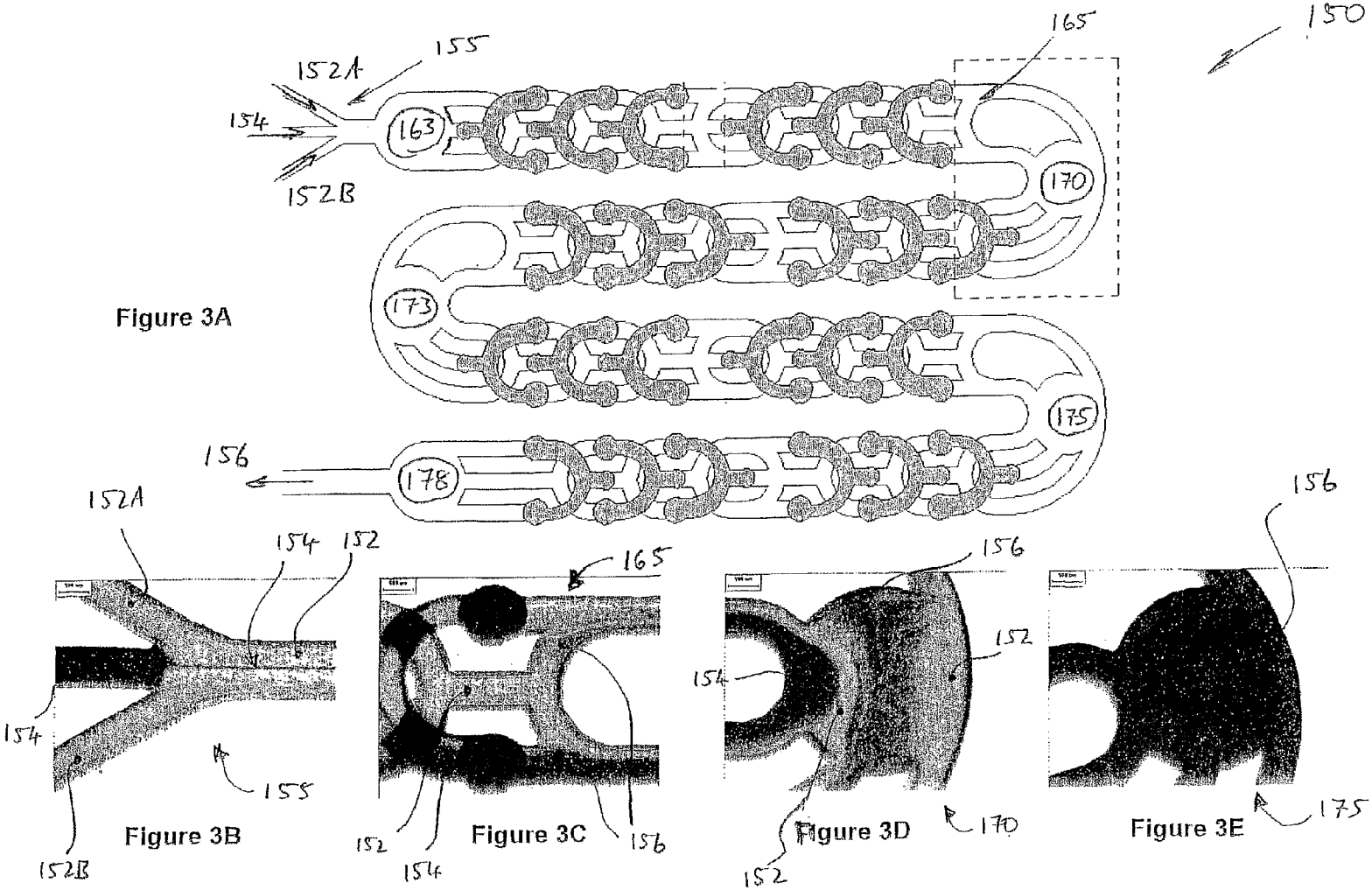
FIG. 3A is a plane view of a microfluidic mixing device according to a further embodiment of the present invention.
FIGS. 3B to 3E are sequential images of two fluids mixing within the microfluidic mixing device of FIG. 3A.

FIG. 3A shows a further embodiment of the present invention whereby a microfluidic mixing device 150 receives two fluids 152 and 154 which are mixed to produce a mixed fluid 156. In this embodiment the device 150 includes four mixing zones separated by chambers 163, 170, 173, 175, 178. The fluids 152, 154 are received through multiple inlets with the high viscosity fluid 152 received through inlets 152A, B and the low viscosity fluid 154 received between the two high viscosity fluid inlets. The width of the bottom layer channel is around 500 μm. The widths for the narrow and wide top-layer channels are respectively 370 μm and 630 μm. The depth of all the channels is around 400 μm. The model is tested using the same complex polymer base solution and water as with FIGS. 2A to 2G, with a viscosity ratio of 5000. The fluid in the middle inlet channel is water, the other is complex polymer base. The flow rate for both the fluids is 40 μL/min.

FIG. 3B to 3E show images of the progressive mixing of the fluids to produce the mixed fluid 156 at various stages through the device 150.

FIG. 3B shows the inlet 155 whereby the two fluids 152, 154 are received. The reduction of the flow of the second fluid 154 can be seen as it comes into contact with the first fluid 152. At this stage no mixing has occurred due to the differential viscosity.

FIG. 3C shows the device 150 at a point between the end of the first mixing zone and the second chamber 170. Here whilst the first fluid 152 dominates flow within the various channels and the second fluid 154 still maintains a small relative flow, there is nevertheless clear evidence of mixing of the fluids produced the mixed fluid 156.

FIG. 3D shows the second chamber 170 which represents the first major expansion of the fluid paths. Here the expansion has led to a more significant proportion of the mixed fluid 156 whilst still showing discreet regions of the first and second fluids 152, 154.

FIG. 3E shows the fourth chamber representing the result of three mixing zones. It will be seen that the chamber 175 is uniformly filled with the mixed fluid 156 with no discernible region of either the first or second fluids.

Accordingly the device 150 shown in 3A is sufficient to mix the two fluids of substantially different viscosities within three mixing zones.

Figure 4A:
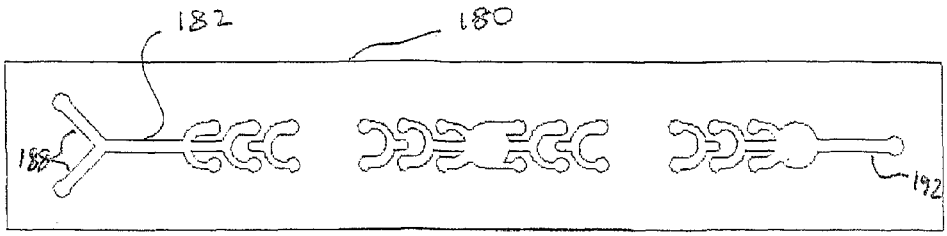
FIGS. 4A to 4I are various views of a microfluidic mixing device according to a further embodiment of the present invention.
Figure 4B:
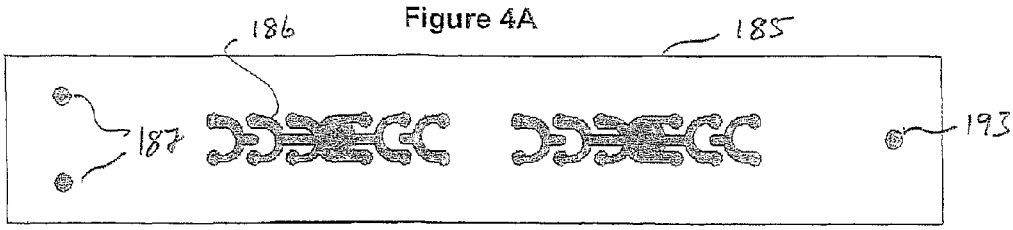
Figure 4C:
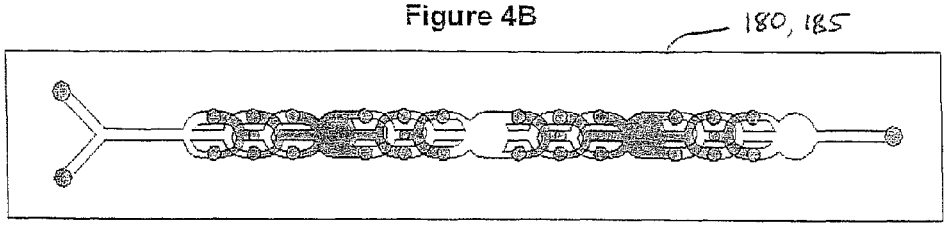
Figure 4D:
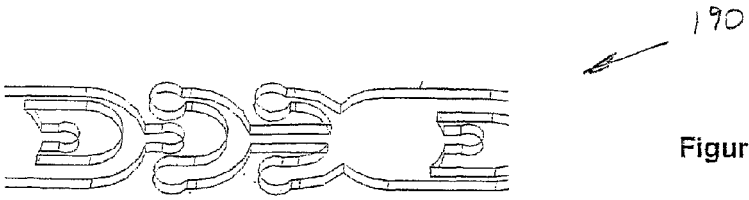
Figure 4E:
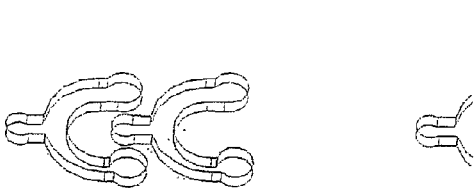
Figure 4F:
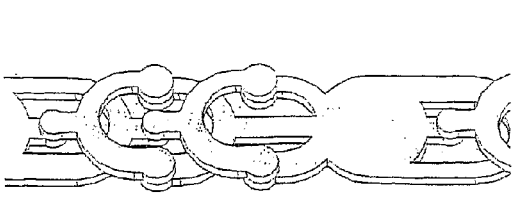
Figures 4G, 4H, 4I:
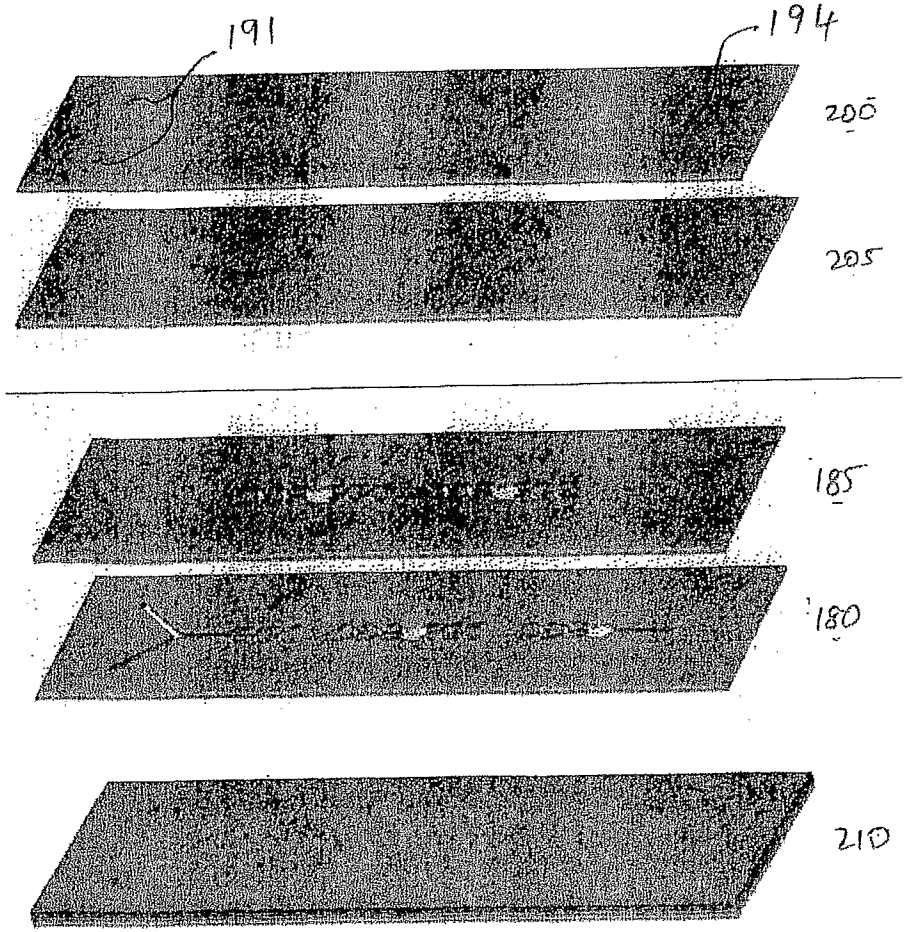

FIGS. 4A to 4I show various views of components which when assembled as shown in FIG. 4I form a microfluidic mixing device 210. FIGS. 4A and 4B show two internal substrates 180, 185 whereby patterns 182, 186 have been stamped or cut out of the substrate. The patterns represent the key shapes of the fluid paths in the two levels of the device. When assembled as shown in FIG. 4C, the two substrates 180, 185 form the flow paths required to achieving the mixing device. The substrates may be metal, plastic or glass, with the most appropriate method of forming the fluid paths being subject to the material.

The three dimensional effect of the fluid paths achieves the desired swapping of relative positions of the fluid paths so as to achieve interaction and interference of the flow. Further, providing substrates having the required shapes cut into the substrates leads to a low cost solution for the manufacture of such devices. Thus the three dimensional structure may be manufactured inexpensively whilst still providing a complex chaotic mixing effect to the introduced fluids.

The four substrates 180, 185, 200, 205 are assembled to form the device 210 with the outer substrates 200, 205 sealing the fluid paths so as to retain fluid within the device. Apertures 191 are provided in one of the external substrates 200 which correspond to apertures 187 in one internal substrate 185 which in turn correspond to the inlet channels 188 for introducing the fluids to the device. Similarly an aperture 194 of the external substrate 200 correspond to an aperture 193 in the aforementioned substrate 185 which corresponds to an outlet channel 192 for removal of the mixed fluid.

Thus the chaotic microfluidic mixing device in its various embodiment provides several distinct strategies for mixing two fluids which may be used separately or together subject to their degree of mixing that is required or the degree of dissimilarity of the fluids to be mixed. Further such a three dimensional chaotic mixer also offers an opportunity for a very low cost means of construction in a still further embodiment through the use of stamped, punched or cut substrates providing the microfluidic channels which are subsequently sealed by external substrates to form a simple assembly as shown in FIG. 4I.

Figure 5:
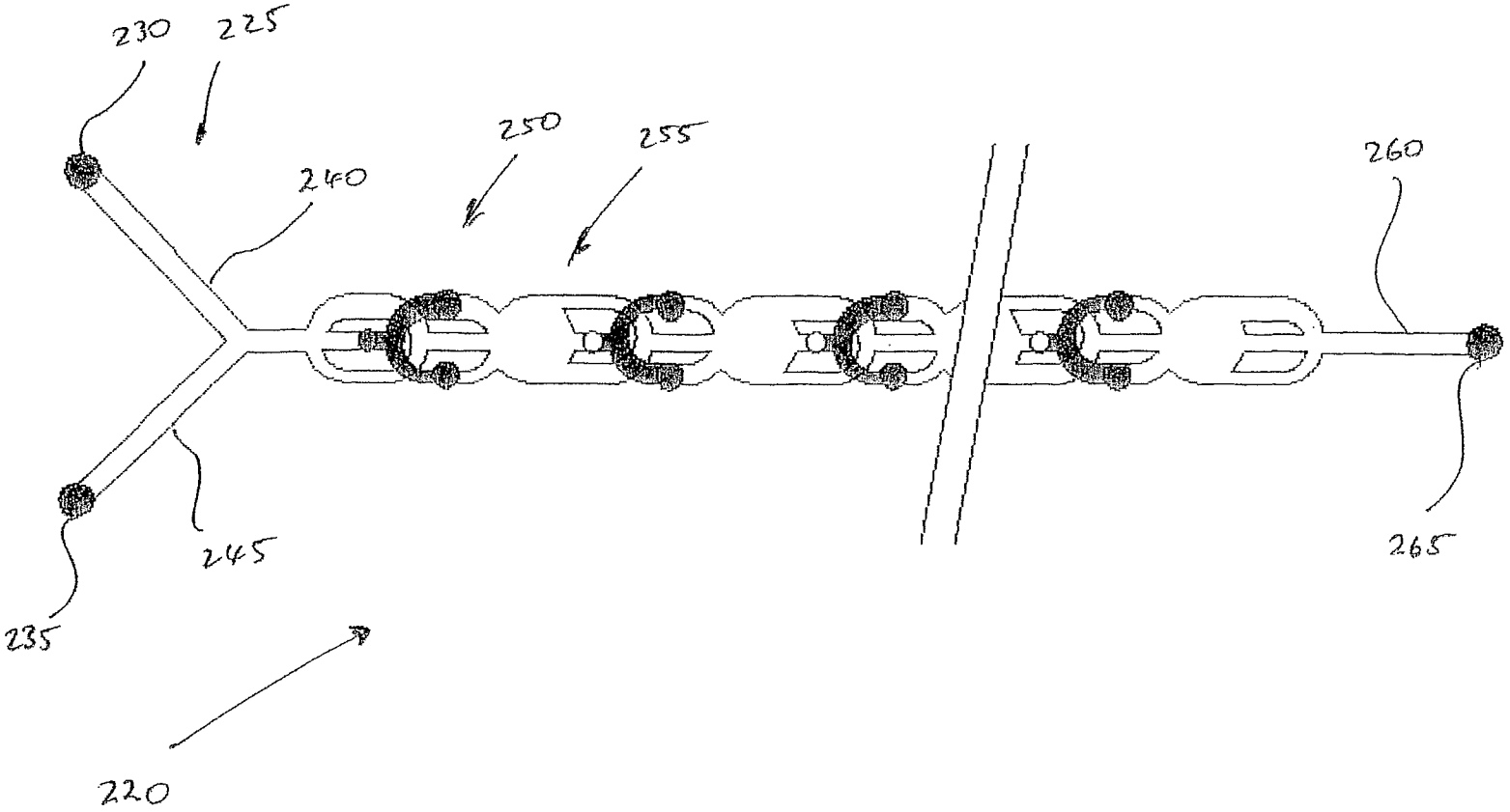
FIG. 5 is a plan view of a microfluidic mixing device according to a further embodiment of the present invention.

FIG. 5 shows a further embodiment of the microfluidic mixing device 220. Here the device is constructed so as to rely on a single module for each mixing zone 250, unlike the double module of FIG. 1A and the quadruple module of FIG. 1B.

The device includes entry points 230, 235 into which fluids are introduced, with lead-in channels 240, 245 directing the fluids into the mixing zone.

The device 220 further includes mixing chambers 255 separating each mixing zone 250. The mixing process ends through the fluid flowing through the final outlet channel 260 to be extracted through exit point 265.

The periodic nature of the mixing device according to the present invention maybe alternatively described as a plurality of modules which have been combined with entry and exit points from the basis of the mixing process.

Figure 6:
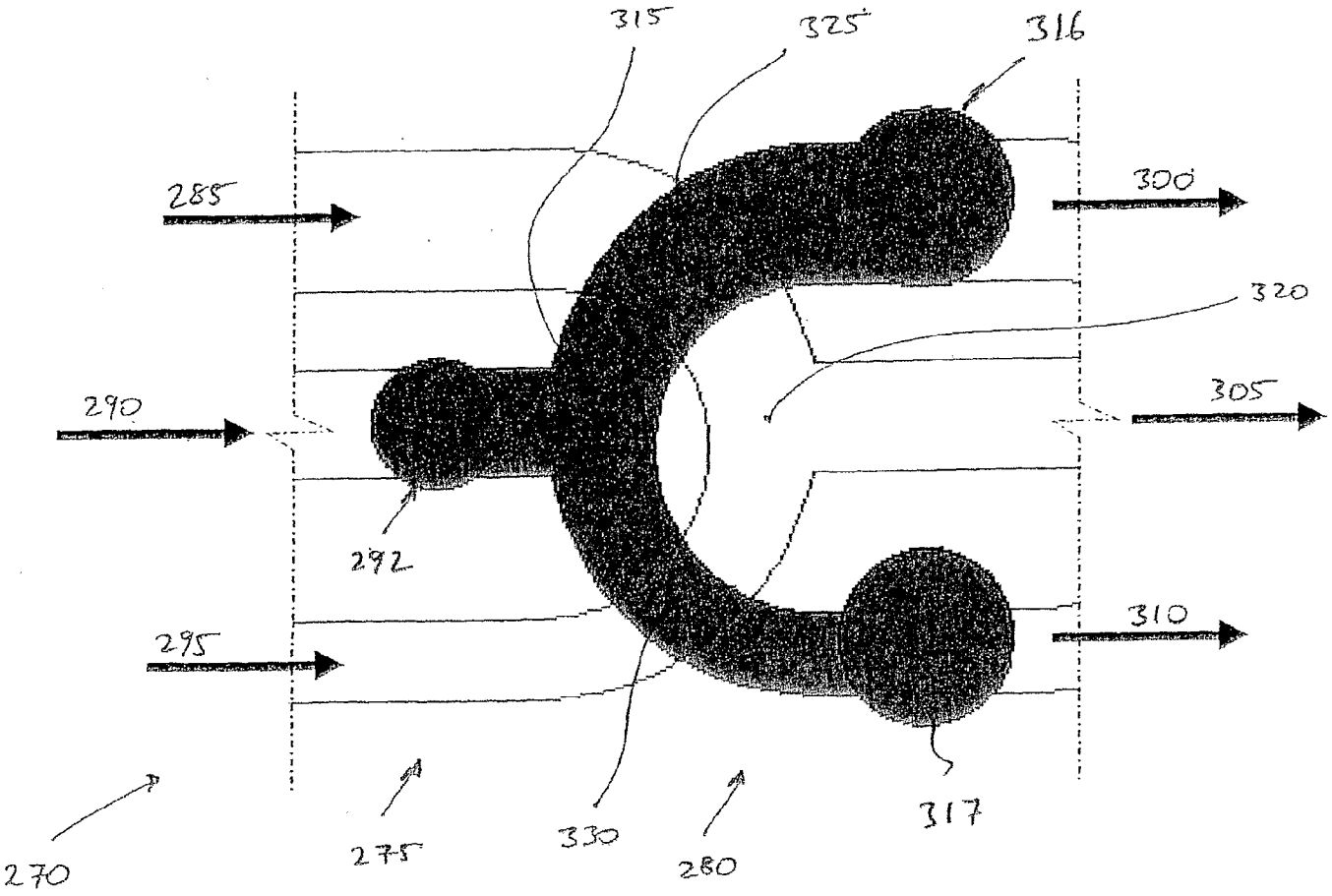
FIG. 6 is a plan view of a microfluidic mixing module according to one embodiment of the present invention.

FIG. 6 shows one such module 270 according to one embodiment of the present invention. Here the module 270 comprises a first fluid path 275 and a second fluid path 280. These fluid paths are variously defined by microfluidic channels. For instance the first fluid path 275 comprises two inlets 285, 295 which received fluid from an upstream source. The channels 285, 295 then meet at a merged point 320 and exit the first fluid path at an outlet 305.

The second fluid path 280 is defined by a single inlet 290 which separates at a division point 315 to eventually flow through outlets 300, 310.

As with previous embodiments, the module 270 is constructed on two separate planes with the second fluid path being substantially in the upper plane. Fluid received through the inlet 290 flows through a cross plane channel 292 from the first plane into the second plane with the highlighted portion of the second fluid path 280 representing the path in the second plane. Downstream from the division point 315 are further cross plane channels 316, 317 which return the flow to the first plane.

Having the fluid paths in respective parallel planes allows for the fluid paths to come into contact at the straight points 325, 330 which include apparatus between the paths to commit fluid communication. As discussed in previous embodiment, the fluid communication promotes mixing the fluid paths and so assisting with the mixing of the fluids. Thus the construction of a microfluidic mixing device accordingly to various embodiments may be defined in terms of modules used in the construction with each module determining a degree of mixing that occurs within the device.

Figure 7:
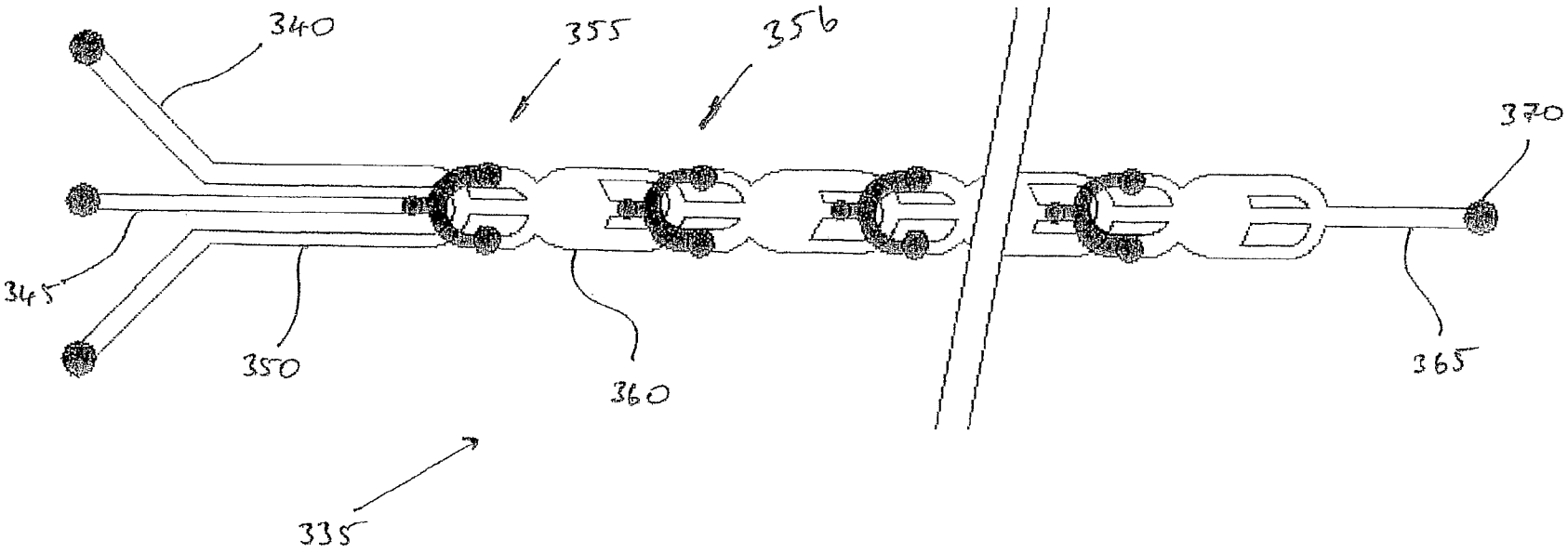
FIG. 7 is a plan view of a microfluidic mixing device according to a further embodiment of the present invention.

For example referring again to FIG. 1B, the mixing zone 86 may be defined as containing four modules 87, 88, 89, 92 whereby the upstream module 87 flows into a downstream module 88 and continues downstream to the module 89 and the final module 92 before entering the in chamber 90. Thus a plurality of modules as shown in the mixing zone 86 of FIG. 1B demonstrates the construction of a microfluidic mixing device from a common building block of the module according to FIG. 6. By way of a further example FIG. 7 shows such a microfluidic mixing device 335 with each period 355 having a single module. Here the three inlets corresponding to the module comprise channels 340, 345, 350 which correspond to the three inlets for a module. The microfluidic mixing device 335 then further includes a chamber 360 into which the fluid flows ready for further mixing in subsequent modules 356. The mixed fluid then can be moved through outlet channel 365 and exit point 370.

Figure 9:
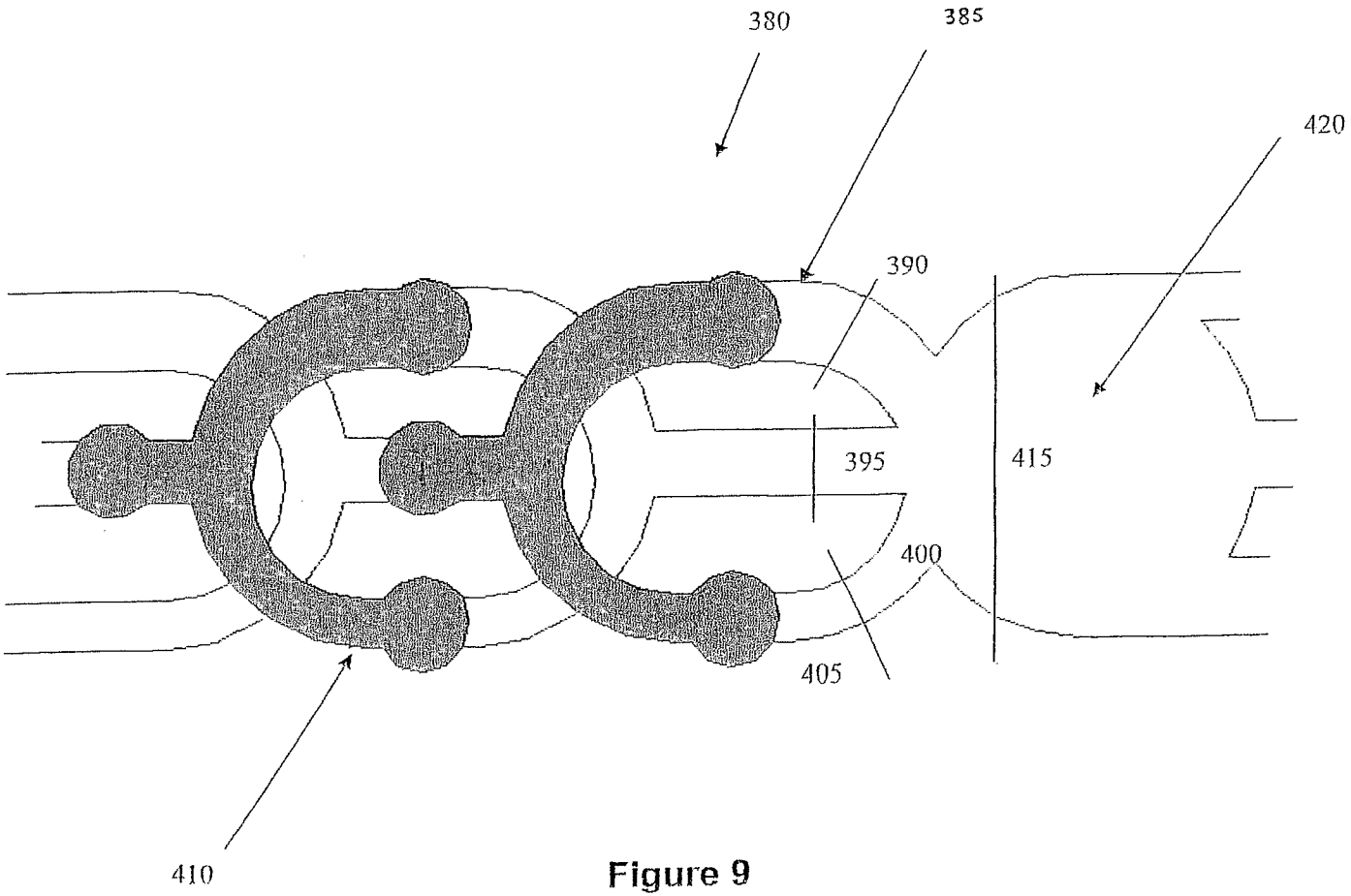
FIG. 9 is a plan view of a microfluidic mixing device according to a further embodiment of the present invention.

FIG. 9 shows a further aspect of the present invention, and in particular displays the most basic elements of the present invention.

Here a mixing zone 380 comprises a first and second fluid path as previously described. Combined with the mixing zone 380 is a mixing chamber 420. The intent is for the fluids to undergo a degree of mixing within the first and second fluid paths, with a chaotic element added to the mixture as the fluids enter the larger mixing chamber. In a further embodiment the mixing chamber may be significantly larger than that of the channels 385, 400, 410 of the first and second fluid paths. Thus the sudden pressure loss experienced by the fluid may lead from laminar flow to turbulent flow as a result of the expansion into the mixing chamber.

In a further embodiment, in order to achieve the expansion effect, the width 415 of the mixing chamber adjacent to the inlet from the first and second paths may be equal to or greater than the sum of the widths 390, 395, 405 of the channels of the first and second fluid path.

Experimental Results

A prototype of a device according to the present invention was fabricated with 2.5 mm-thick PMMA plate and using CNC micro-milling. A DIXI end mill 7256 Ø0.35 was used for machining of the microstructures. The channel widths are: $w_0$=600, $w_1$=450, $w_2$=750 (μm). The diameter of the chamber is 3.45 mm. The structure depth for both the layers is 400 μm.

Figure 8A:
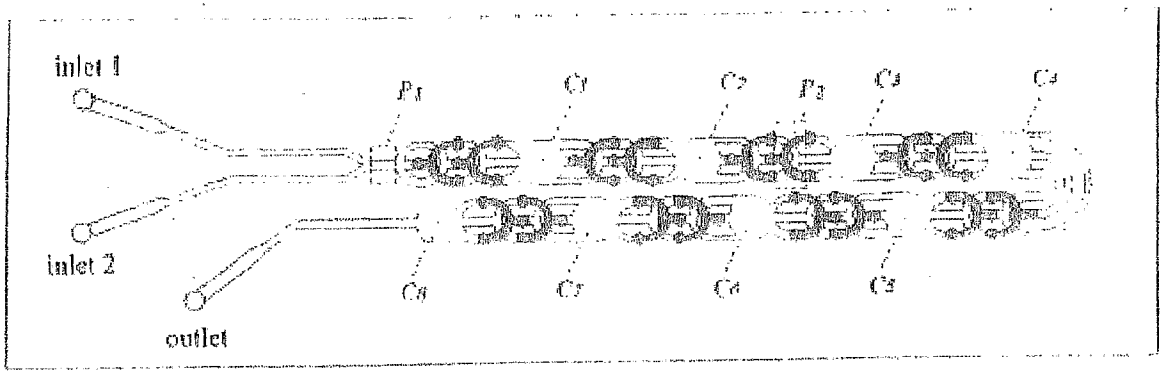
FIG. 8A is a plan view of an experimental device according to one embodiment of the present invention.
Figure 8B:
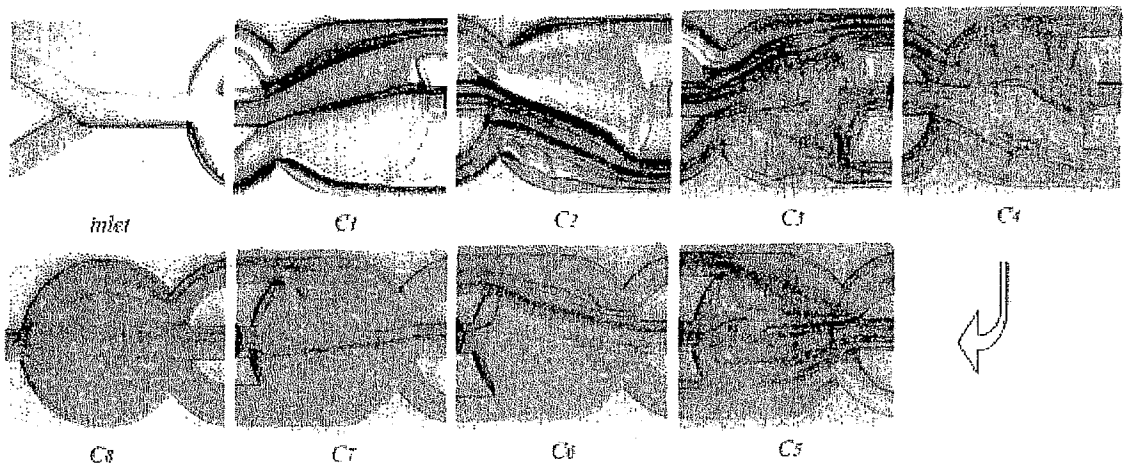
FIG. 8B is a characteristic of a process according to one embodiment of the present invention.

The device was examined using glycerol (with 2 vol % phenolphthalein pH indicator) and 1 wt % NaOH aqueous solution. Their flow rates are indicated with $Q_1$ and $Q_2$. At $Q_1$=$Q_2$=0.2 ml/min, the average Re is around $\overline{Re}\approx 2.8$. Roughly speaking, the flow and mixing can be divided into three stages, as shown in FIGS. 8A and 8B.

The first stage is from the inlet to chamber $C_2$. In this stage, the less viscous liquid is confined by the more viscous liquid to form thin fluid streams. The flow is stable and the mixing mainly relies on diffusion. Starting from $C_2$, the flow automatically transits to an unstable state. Slight instability first appears at the bottom of $C_2$ (left side when facing the incoming flow), and it grows stronger downstream. In $C_3$ the flow turns to fully developed turbulence. After that, the flow slowly calms down in the $4^{th}$ and $5^{th}$ mixer unit. In this stage, the mixing is significantly improved by the turbulent fluid motion. Through efficient mixing, the homogeneity of the fluids has been much improved. After $C_5$, the flow restores to the steady state.

The mixer is further tested using more viscous complex polymer samples. The samples are shear-thinning fluids, for which the viscosities decrease with the increasing rate of shear stress. Three samples were tested. The changes in their viscosities with the shear rate were measured using an Anton Paar rheometer (Physica MCR 301). At shear rate 1 l/s, their viscosities are: SBS1, 5440; SBS2, 17300; SBS3, 54600 cP. The samples are to be mixed with water inclusive 1% food dye (around 1 cP).

What is claimed is:

1. A microfluidic mixing device for mixing at least two fluids to form a mixed fluid comprising:

a first mixing chamber for receiving the fluids from at least a first and a second fluid paths;

a mixing zone upstream from the mixing chamber having the first and second fluid paths;

said first and second fluid paths overlapping at first and second discreet points so as to provide mutual fluid communication between the first and second paths at said discreet points, wherein at least one of the first and second fluid paths includes a primary channel and a plurality of divided channels dividing from the primary channel at a first node, and projecting to a second node whereupon said plurality of channels are recombined, wherein a width of the mixing chamber adjacent to an inlet of the first and second fluid paths entering the mixing chamber is equal to or greater than the sum of the widths of the channels of the at least one of the first and second fluid paths immediately upstream of the mixing chamber, and wherein at least one of said divided channels is of a greater flow capacity than at least one of said remaining divided channels.

2. The microfluidic mixing device according to claim 1, wherein the relative position of the first and second fluid paths at the first discrete point is diametrically opposed to the relative position of the first and second paths at the second discreet point.

3. The microfluidic mixing device according to claim 1, further comprising:

a start chamber into which the at least two fluids are received;

said mixing zone intermediate the start and mixing chambers such that the first and second fluid paths extend from the start chamber to the mixing chamber.

4. The microfluidic mixing device according to claim 3 further including a second mixing zone and a second mixing chamber, said second mixing zone intermediate the first mixing chamber and the second mixing chamber.

5. The microfluidic mixing device according to claim 3 wherein at least one of said fluid paths have at least a portion of said path extending outside of a plane defined by the start chamber.

6. The microfluidic mixing device according to claim 5 wherein said portion coincides with said discreet points.

7. The microfluidic mixing device according to claim 4 wherein said first mixing chamber includes an inlet for the introduction of a third fluid to the second mixing zone.

8. The microfluidic mixing device according to claim 3 wherein said device includes a plurality of start/mixing chambers with mixing zones intermediate said start/mixing chambers such that the microfluidic device includes a plurality of cycles of mixing zones.

9. The microfluidic mixing device according to claim 1 wherein said device comprises two external sealing substrates and two internal substrates, said internal substrates having the fluid paths formed in said substrates such that the external and internal substrates are arranged to cooperatively engage to form said device.

10. The microfluidic mixing device according to claim 1, wherein the mixing zone comprises at least one module comprising:

at least three inlets;

at least three outlets;

the first fluid path defined by channels from two of said inlets merging to form a single channel to connect with one of said outlets, and;

the second fluid path defined by a channel from the third inlet dividing to form two channels to connect with the remaining two outlets.

11. The microfluidic mixing device according to claim 10, wherein said discreet location positioned upstream of a point of merger of the channels of the first path and downstream from a point of division of the channels of the second path.

12. The microfluidic mixing device according to claim 10 wherein at least a portion of the channels defining the first path and at least a portion of the channels defining the second path are located on respective parallel planes.

13. The microfluidic mixing device according to claim 12, wherein the point of merger and point of division are respectively located on said parallel planes.

* * * * *